US005103643A

United States Patent [19]

Ross

[11] Patent Number: 5,103,643

[45] Date of Patent: Apr. 14, 1992

[54] TRANSPOSED COMPRESSION PISTON AND CYLINDER

[76] Inventor: Melvin A. Ross, 8169 Lake Bluff Ct., Columbus, Ohio 43235

[21] Appl. No.: 667,621

[22] Filed: Mar. 11, 1991

[51] Int. Cl.[5] ..... F02G 1/053

[52] U.S. Cl. ..... 60/517

[58] Field of Search ..... 60/517, 525, 526; 62/6

[56] References Cited

U.S. PATENT DOCUMENTS 4,738,105 4/1988 Ross et al. ..... 60/517

*Primary Examiner*—Allen M. Ostrager

*Attorney, Agent, or Firm*—Frank H. Foster

[57] ABSTRACT

A compression piston and cylinder mechanism for the V type two piston Stirling engine which substantially reduces engine dead volume without increasing complexity or decreasing mechanical efficiency. A stepped piston is attached at its smaller outer portion to a relatively long connecting rod. The piston seal is located at the larger inner portion of the piston, thereby permitting a short passage of low dead volume to connect the volume swept by the compression piston to the engine's heat exchangers. A stepped cylinder corresponds to the shape of the piston, having a smaller outer portion that sustains the side loading resulting from connecting rod angularity, and a larger inner portion that the piston seals against.

6 Claims, 1 Drawing Sheet

TRANSPOSED COMPRESSION PISTON AND CYLINDER

BACKGROUND OF THE INVENTION

This invention provides a simple and practical method to improve the performance and life of a single-acting two piston Stirling engine without at the same time increasing its complexity or decreasing its mechanical efficiency.

It is generally agreed that the single-acting two piston Stirling engine is one of the most desirable forms of Stirling for small power applications, having demonstrated both simplicity and good performance. Such engines may be designed in a variety of forms; for example, cylinders may be arranged in a V, in-line, or horizontally opposed.

One of the most desirable arrangements is the V type engine, in which the cylinders are generally located radially off of a common crankpin and 90° apart from each other. This arrangement provides mechanical simplicity and strength, proper piston phasing for the Stirling cycle, and excellent dynamic balance. There are, however, two related disadvantages of this arrangement, which are; 1) the pistons are side-loaded by the periodic angularity of the connecting rods, which can produce high wear and high friction in the preferred oil-less design unless long connecting rods are used, and, 2) as the connecting rods are made proportionally longer to reduce this side-loading, the cylinder heads become farther apart, requiring larger plenums and heat exchangers, with increased performance-robbing dead volume, to connect them. The designer who chooses efficient compact heat exchangers and connecting plenums will be left with poor performance due to short connecting rods, and the designer who chooses efficient long connecting rods will be left with poor performance due to large dead volume in the heat exchangers and associated plenums.

The aim of this invention is to disclose a new form of compression piston and cylinder that will allow the engine designer to incorporate both compact heat exchangers and plenums, and efficient long connecting rods, on the V type Stirling engine.

Other aims, features, and advantages will be apparent in the description, below.

SUMMARY OF THE INVENTION

This invention is a transposed compression piston and cylinder for the V type two piston engine which allows the cylinders to be connected by compact heat exchangers and ducts, while retaining the use of mechanically efficient long connecting rods.

In one example, a crankshaft is mounted in a bore that transversely intersects two cylinders arranged 90° apart from each other, with one of said cylinders extending vertically from the crankshaft bore, and the other extending horizontally. A single crankpin on the crankshaft is attached to two connecting rods, one going into each of the two cylinders. The center to center length of these connecting rods is at least 6 times the crankthrow radius. In the vertical cylinder is a conventional expansion piston, attached by a wrist pin to its respective connecting rod. The engine's heater, regenerator, and cooler are arranged in an annular fashion around this cylinder.

The horizontal compression cylinder has two concentric bores along a common extended axis, with a conic section connecting them. Close to the crankshaft is the inner portion of the cylinder, comprising a large bore in which the compression piston seal rides. The connecting conic section incorporates a port communicating directly to the cooler. Beyond the conic section is a small bore (relative to the large bore previously described) outer portion of the compression cylinder, which essentially extends the cylinder to accommodate the long connecting rod. This outer portion of the cylinder will absorb the side loading of the piston due to connecting rod angularity.

The compression piston comprises a large diameter inner portion which carries the seal and a small wear band. A conic section connects this inner portion with a cylindrical outer portion of a smaller diameter containing a sealed wrist pin and a large wear band. To facilitate good dynamic balance, this piston is designed to have the same mass as the expansion piston, which is counterbalanced on the crankshaft.

DESCRIPTION OF THE PREFERRED EMBODIMENT

This invention is a transposed compression piston and cylinder for the V type two piston engine. In one example, a crankshaft is mounted in a bore that transversely intersects two cylinders arranged 90° apart from each other, with one of said cylinders extending vertically from the crankshaft bore, and the other extending horizontally. A single crankpin on the crankshaft is attached to two connecting rods, one going into each of the two cylinders. The center to center length of these connecting rods is at least 6 times the crankthrow radius. In the vertical cylinder is a conventional expansion piston, attached by a wrist pin to its respective connecting rod. The engine's heater, regenerator, and cooler are arranged in an annular fashion around this cylinder.

The horizontal compression cylinder has two concentric bores along a common extended axis, with a conic section connecting them. Close to the crankshaft is the inner portion of the cylinder, comprising a large bore in which the compression piston seal rides. The connecting conic section incorporates a port communicating directly to the cooler. Beyond the conic section is a small bore (relative to the large bore previously described) outer portion of the compression cylinder, which essentially extends the cylinder to accommodate the long connecting rod. This outer portion of the cylinder will absorb the side loading of the piston due to connecting rod angularity. As used herein, "inner" and "outer" refer to a component's relative proximity to the crankshaft, which is the center of the engine.

The compression piston is transposed, so that its seal is closer to the crankshaft than are its wrist pin and side-load bearing portions, which is the opposite of conventional pistons. This piston comprises a large diameter inner portion which carries the seal and a small wear band. A conic section connects the inner portion of the piston with a cylindrical outer portion of a smaller diameter, which contains a sealed wrist pin and a large wear band. Sufficient clearance or other relief means is provided in the outer portion of the piston to permit free passage of the working gas among all parts of the cylinder at all times. Alternatively, this relief means may be located in the clyinder, rather than in the piston. The diameter of this outer portion of the piston is as small as possible, consistent with the loads it must bear, to minimize the dead volume associated with it and its relief means. To facilitate good dynamic balance, the compression piston is designed to have the same mass as the expansion piston, which is counterbalanced on the crankshaft.

The invention will be more fully explained with reference to the accompanying drawing, which represents an example thereof.

Figure 1:
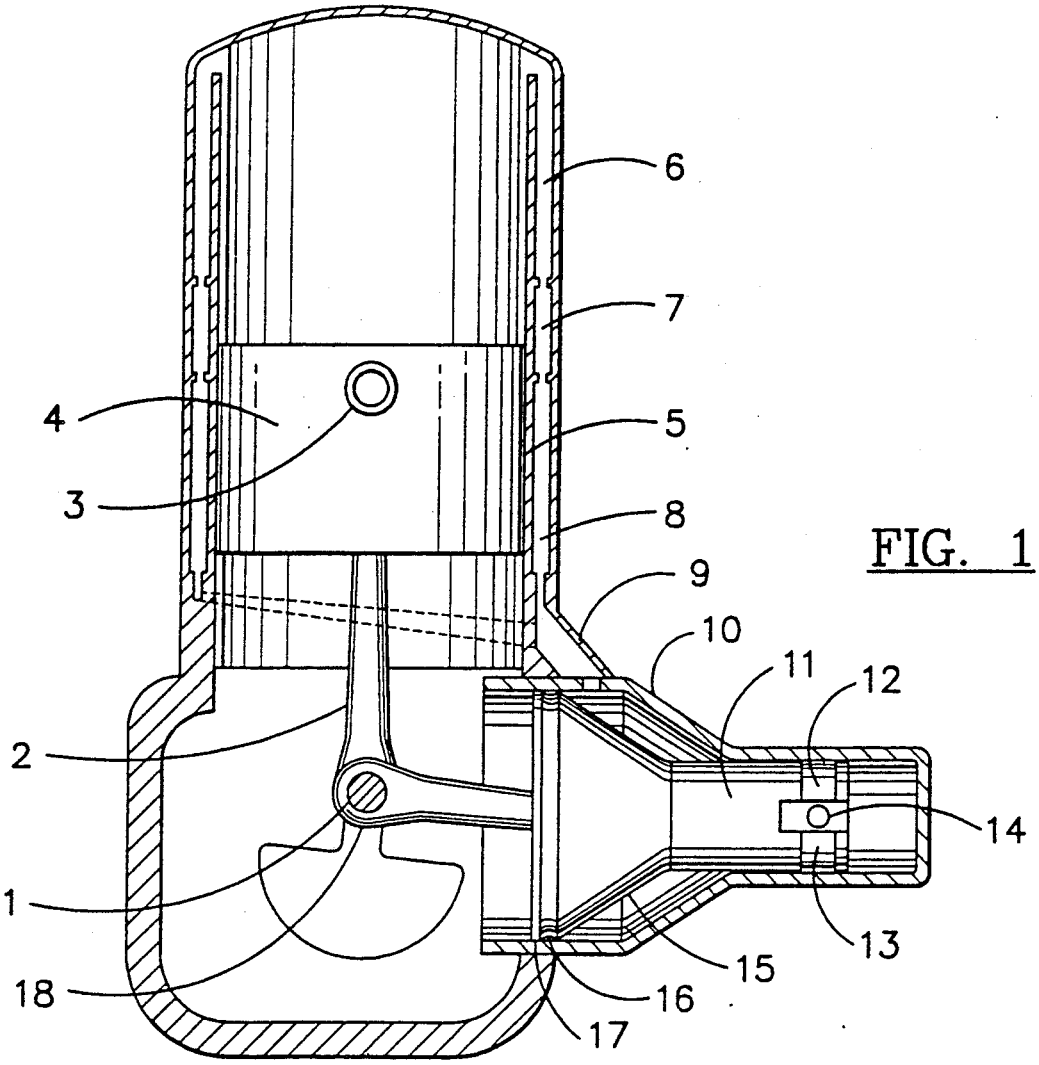
FIG. 1 is a schematic section end view of a two piston V type engine incorporating the invention.
Figure 2:
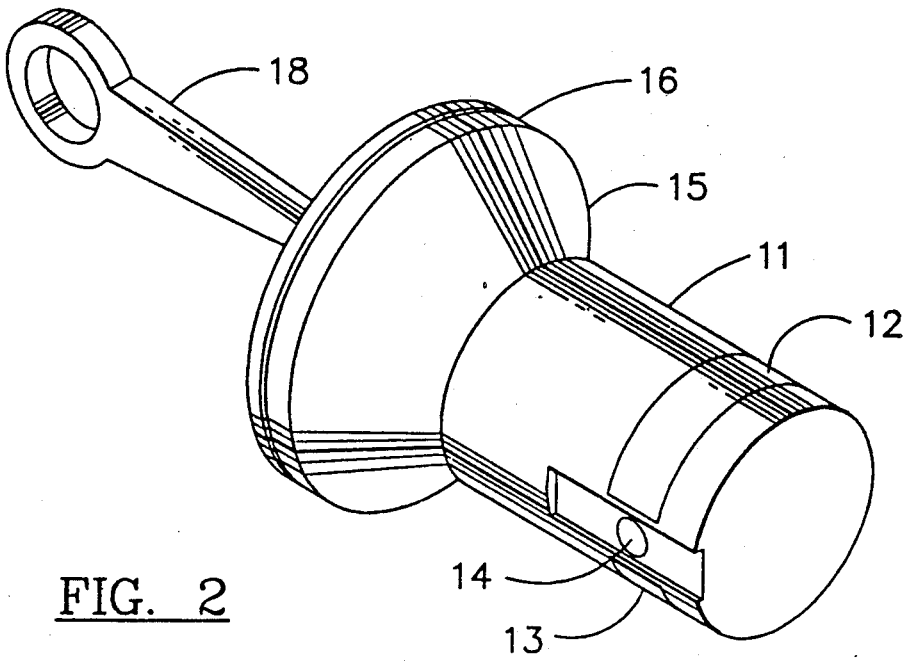
FIG. 2 is a prospective view of the compression piston shown in isolation.

FIG. 1 shows a section end view of a two piston V type Stirling engine incorporating the invention. Crankpin, 1, is attached by connecting rod, 2, to wrist pin, 3, and expansion piston, 4, which piston reciprocates in expansion cylinder, 5. Surrounding expansion cylinder, 5, and connected in series with it are heater, 6, regenerator, 7, and cooler, 8. Beneath cooler, 8, is duct, 9, connecting said cooler with compression cylinder, 10. Inside said compression cylinder reciprocates the transposed compression piston. As shown in FIG. 2, the compression piston comprises an outer cylindrical portion, 11, wear bands, 12 and 13, wrist pin, 14, conic section, 15, seal, 16, and wear band, 17. Connecting rod, 18, connects wrist pin, 14, with crankpin, 1.

What I claim is;

1. An improved V-type two piston Stirling engine wherein the improvement is a transposed compression piston slidably engaged in a mating cylinder and comprising:

a cylindrical body which is pivotally connected to a connecting rod at a pivot axis which is relatively nearer the outer end of the cylindrical body and has a seal relatively nearer the inner end of the cylindrical body.

2. An improved V-type two piston Stirling engine wherein the improvement is a transposed compression piston and cylinder comprising:

(a) a compression piston comprising:

(1) an outer cylindrical portion having a relatively smaller diameter and having a sealed wrist pin and wear band means for reducing friction;

(2) an inner cylindrical portion of relatively larger diameter and having a peripheral seal; and (3) a piston connecting wall joining the inner and outer portions of said piston; and (b) a compression cylinder comprising:

(1) an outer cylindrical portion of relatively smaller diameter matingly and slidably receiving the outer cylindrical portion of the piston;

(2) an inner cylindrical portion of relatively larger diameter matingly and slidably receiving the inner cylindrical portion of the piston; and (3) a cylinder connecting wall joining the inner and outer portion of the cylinder.

3. An engine in accordance with claim 2 wherein a port is formed in the cylinder connecting wall, connecting said cylinder in fluid communication with other chambers of said engine.

4. An engine in accordance with claim 3 and further comprising a passageway means for providing free fluid communication between all volumes between the inner surface of the cylinder and the outer surface of the piston.

5. An engine in accordance with claim 4 wherein the passageway means is formed by a relieved portion of the exterior surface of the piston.

6. An engine in accordance with claim 4 wherein the passageway means is formed by a relieved portion of the interior surface of the cylinder.

* * * * *